United States Patent [19]

Larson et al.

[11] 4,155,422

[45] May 22, 1979

[54] COMBINATION STEP, STAIR WELL AND EXTENSION LADDERS

[75] Inventors: Clayton E. Larson, Brooklyn, N.Y.; Edwin H. Lemp, Bellows Falls, Vt.

[73] Assignee: White Metal Rolling & Stamping Corp., Brooklyn, N.Y.

[21] Appl. No.: 921,253

[22] Filed: Jul. 3, 1978

[51] Int. Cl.[2] ..... E06C 1/18; E06C 7/14

[52] U.S. Cl. ..... 182/25; 182/124; 182/166

[58] Field of Search ..... 182/22, 23, 24, 25, 182/26, 124, 125, 126, 166, 167, 175

[56] References Cited

U.S. PATENT DOCUMENTS

| | | | |
|---|---|---|---|
| 2,899,008 | 8/1959 | Larson | 182/166 |
| 3,009,535 | 11/1961 | Larson | 182/124 |
| 3,269,485 | 8/1966 | Larson | 182/124 |

*Primary Examiner*—Reinaldo P. Machado
*Attorney, Agent, or Firm*—Carroll F. Palmer

[57] ABSTRACT

Combination step, stair well and extension ladders are characterized by a single bracket member by which a bucket rack and the top rear section are pivoted to the front step section, the bucket rack is supported by telescoping channel members, spring-biased hooks are pivoted on the top rear section to make locking engagement with the top step of the ladder's front step section and snap pin units are carried by brackets on the lower rear section to interlock with holes in the sides of the top rear section to adjust the length of the ladder when it is in the extension ladder configuration.

8 Claims, 17 Drawing Figures

FIG. 13
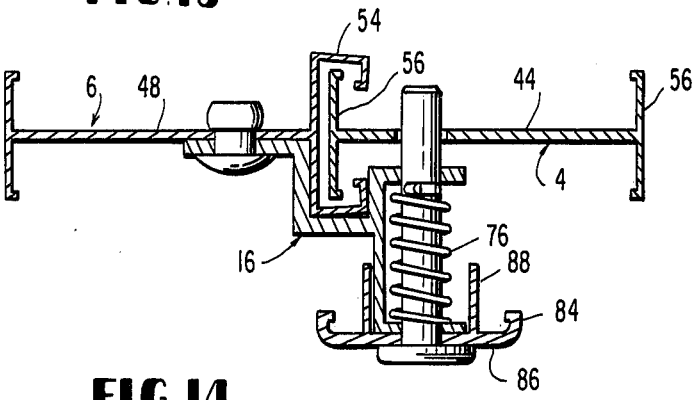
FIG. 14
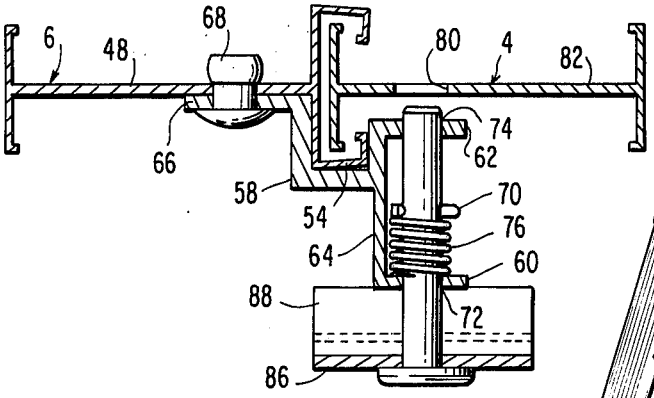
FIG. 17
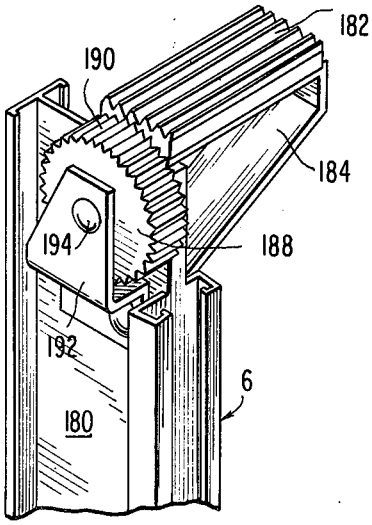
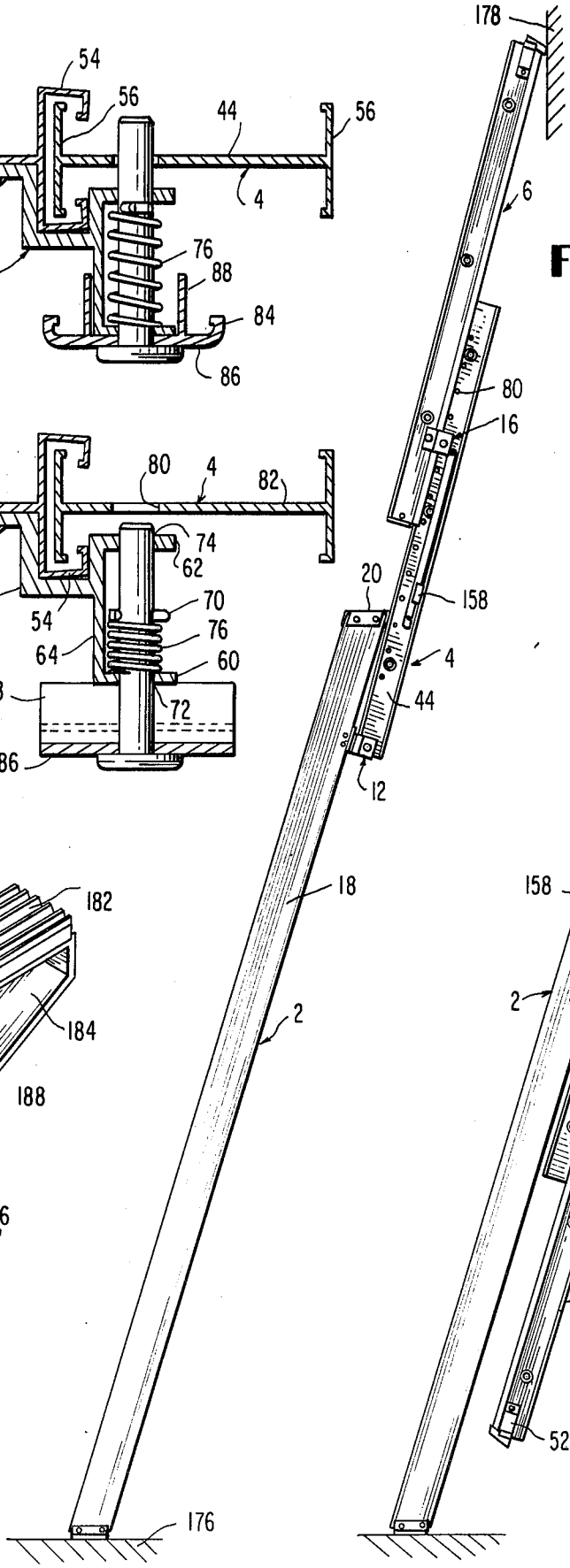
FIG. 15
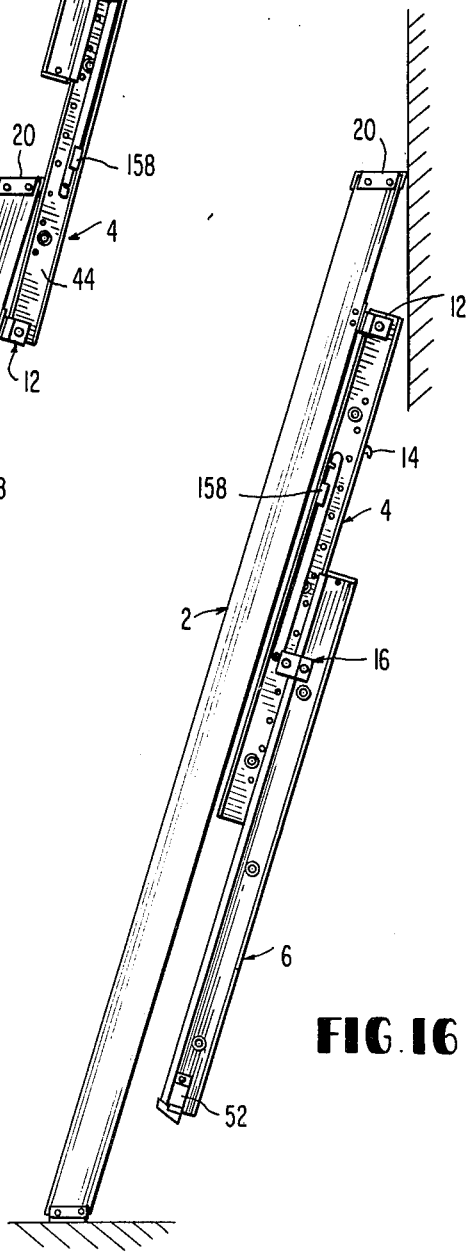
FIG. 16

COMBINATION STEP, STAIR WELL AND EXTENSION LADDERS

BACKGROUND OF THE INVENTION

1. Field of the Invention

This invention relates to ladders and specifically, to combination ladders that may be easily converted into three different basic forms, namely, a stepladder, an extension ladder and a stair well ladder.

2. Description of the Prior Art

Combination ladders that may be changed from one standard form into another, e.g., from a stepladder into an extension ladder are well known. U.S. Pat. No. 758,659 discloses an early development in combination ladders having telescoping legs so that it can be converted from a regular stepladder into a stair well ladder. However, such ladder does not convert into an extension ladder, but U.S. Pat. No. 2,152,846 discloses a stepladder which may be changed into an extension ladder.

Although wood was historically the basic material from which ladders of all types were made, light metals, such as aluminum, have now replaced wood as the principal construction material for ladders. A recent development of a combination ladder is disclosed in U.S. Pat. No. 2,899,008 so designed that it not only is convertible into either a step, extension or stair well ladder, but also includes a bucket rack.

In spite of the numerous advances that have been made in construction of combination ladders as represented by the foregoing and other prior art, there exists a continuing and strong demand in the trade for further improvements that will substantially reduce manufacturing labor, reduce costs of production and increase ease and safety of use of such ladders.

OBJECTS

A principal object of this invention is the provision of new improvements in combination step, stair well and extension ladders.

Further objects include the provision of:

(1) Combination ladders that can be made of metal with minimum labor and at low costs of production.

(2) Such ladders that have improved bucket rack and rear section bracketing.

(3) Improved means for holding combination ladders in an extension configuration.

(4) Improved means for adjusting the length of such ladders when in the extension configuration.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The foregoing objects are accomplished according to the present invention by providing improvements to combination step, stair well and extension ladders that basically are formed by a front section comprising a pair of side rails with a plurality of spaced apart steps carried therebetween, a top rear section formed by two upper side channel members with rungs fixed therebetween at spaced intervals, a bottom rear section formed by two lower side channel members that telescope with said upper side channel members and have rungs fixed therebetween at spaced intervals, a bucket rack hinged upon the ladder and spreader strap means to hold the ladder sections in the stepladder or stair well configuration.

The improvements of the invention upon such forms of combination ladders comprise:

A. single bracket means by which both the bucket rack and top rear section of the ladder are pivoted to the front step section thereof, B. a bucket rack supported by telescoping channel members, C. spring-biased hooks pivoted to the upper side channel member of the top rear section in position to make locking engagement with the top step of the front step section to hold the ladder in an extension configuration, and D. snap pin units carried by brackets on the sides of the lower side channels to interlock with holes positioned in the sides of the upper side channel member by which the length of the rear section may be adjusted when in the extension configuration or in the stair well configuration.

BRIEF DESCRIPTION OF THE DRAWINGS

A more complete understanding of the new combination ladders of the invention and their manner of use may be obtained by reference to the accompanying drawings in which:

FIG. 13 is a sectional view taken on the line 13—13 of FIG. 12.

FIG. 14 is a sectional view corresponding to FIG. 13 showing the snap-lock in unlocked position.

FIG. 15 is a lateral view showing the ladder of FIG. 1 in its extension ladder configuration.

FIG. 16 is a lateral view showing the use of the ladder of FIG. 1 as a plain, single length ladder.

FIG. 17 is a fragmentary isometric view of a modified form of padded foot for the new ladders.

DETAILED DESCRIPTION OF THE PREFERRED EMBODIMENTS

Figure 1:
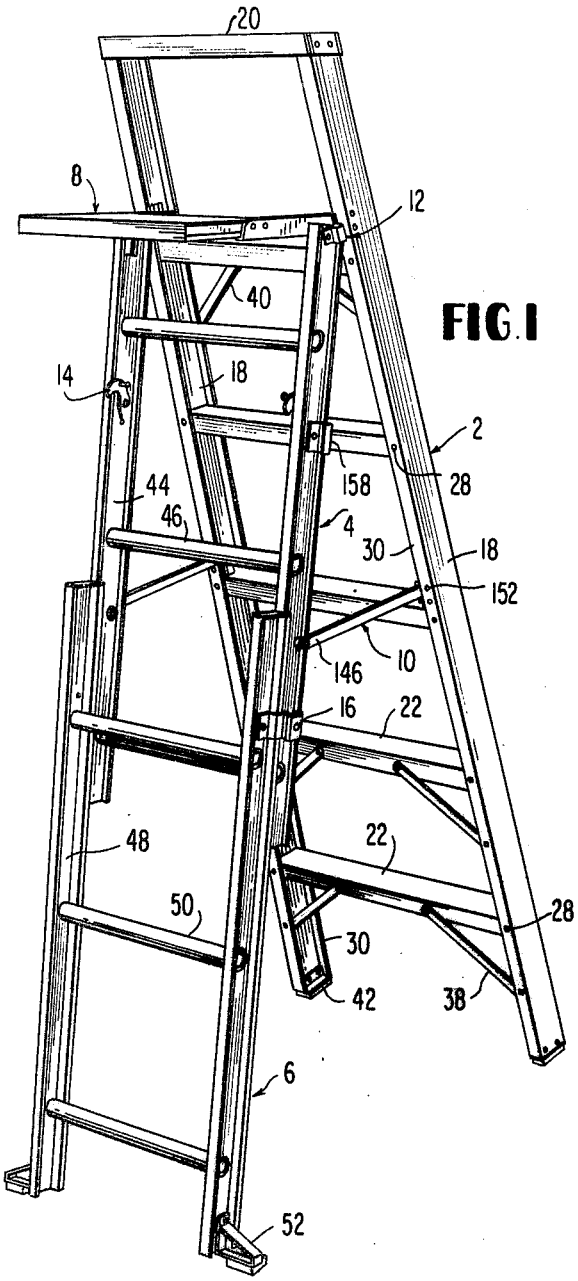
FIG. 1 is a perspective view of a stepladder constructed in accordance with the invention arranged in its stepladder configuration.

Referring in detail to the drawings, the new combination ladders basically comprise a front step section 2, a top rear section 4, a bottom rear section 6, a bucket rack 8, spreader strap means 10, bracket means 12, spring-biased hooks 14 and snap pin units 16.

The front step section 2 comprises a pair of side rails 18 formed of metal channels, a top step 20 and a plurality of lower steps 22 spaced apart from one another. The steps 22 are metal channels having a step portion 24 and depending sides 26. The steps 22 are fixed between the side rails 18 by rivets 28 which pass through the step sides 26 and flanges 30 in the front and rear of the side rails 18.

Each succeeding step 22 is made slightly wider than the one above it so that the front step section 2 tapers outwardly from the top to the bottom, such as about one inch per foot of height. Steps 20 and 22 and side rails 18 are preferably made of aluminum metal by extrusion. All of the steps, including the top step 20, are preferably set at a slight angle, such as at about 17°, to the side rail so that when the ladder is arranged in its stepladder configuration as in FIG. 1 or the stair well configuration as in FIG. 2, the step portions 24 of the steps will be substantially horizontal.

In contrast to the lower steps 22, the top step 20 has depending end flanges 32 by which the top step is fixed by rivets 34 over the top end of the side rails 18 and the top step 20 is slightly wider than the lower steps 22 so that depending sides 36 thereof enclose the flanges 30 of the side rails 18.

Resistance against sway in use of the ladder is provided in the front step section 2 by a plurality of rear braces 38 and front braces 40 which are riveted at one end to depending sides 26 of the steps and at the other end to flanges 30 of the side rails. Also, the bottom ends of the side rails have rubber padded feet 42 riveted thereto.

The top rear section 4 of the ladder comprises a pair of upper side channel members 44 with a plurality of rungs 46 fixed between channel members 44 at spaced intervals. Rungs 46 are advantageously formed of extruded aluminum tubing with surface serrations to provide an anti-slip feature and are fixed in the side channels 44 by being inserted in holes in the side channels and then pressed or peened.

The bottom rear section 6 is formed by two lower channel members 48 with rungs 50 fixed therebetween at spaced intervals, the rungs 50 being constructed and fixed to the channels 48 in a manner similar to that described in connection with the top rear section 4. The lower end of the side channel members 48 are provided with enlarged feet 52 to give added stability to the ladders when used in the stepladder or stair well configuration.

The bottom rear section 6 telescopes with the top rear section 4 enabling the combined length of these two sections to be adjusted when the ladder is used in the stair well or extension ladder configurations. Both side channels 44 and 48 are basically I-sections, but channels 48 comprise integral L-shaped lugs 54 that slidably enclose a lateral flange 56 of channel 44 (see FIGS. 13 & 14).

The snap pin means 16 permits the top rear section 4 and bottom rear section 6 to be held in varied relative telescoped positions. The means 16 comprises a channel 58 having a pair of transverse parallel sides 60 and 62 extending from one face 64 thereof and an integral Z-shaped flange 66 projecting therefrom opposite to the parallel sides 60 and 62. The channel 58 is fixed, such as by rivet 68 to the central web portion 70 of the channel 48. The flange 66 is designed to embrace one of the lugs 54 so that the single rivet 68 is capable of completely locking the channel 58 in rigid position upon the bottom rear section 6.

In the pin means 16, the lock pin 70 is slidably held in holes 72 and 74 present in parallel sides 60 and 62 respectively. A coil spring 76 is compressed between the cotter pin 78 and the inside surface of the transverse side 60 of channel 58. In the locking position shown in FIG. 13, the lock pin 70 extends through any one of a series of holes 80 provided in the central web portion 82 of the channels 44 of the top rear section 4. The lock pin 70 may be retracted from the hole 80 into the unlocked position shown in FIG. 14 by the saddle member 84. The member 84 comprises a web 86 and two integral normal flanges 88 spaced apart to embrace the channel end 60 in the locking position (see FIG. 13). When the lock pin 70 is in the unlock position (see FIG. 14), the saddle member 84 is turned ninety degrees so that the flanges 88 rest on the end 60 and hold the pin 70 out of the holes 80. Upon correct relative positioning of the rear sections 4 and 6, such as required for stair well use (see FIG. 2), the sections 4 and 6 are locked by another ninety degree turn of saddle member 84 which permits the pins 70 to snap into locking position.

The bucket rack 8 of the new ladders comprises a pair of first parallel channel members 90, a plurality of spaced apart slats 92 and a second pair of channel members 94. The members 90 have a leg 96 with off-set end 98 and transverse web 100 while the channel 94 has a U-shaped section plus a lateral lug 102. The member 90 is slidably carried in the member 94 so the member 90 may telescope with member 94. The slats 92 are fixed to the channels 90 at their ends by rivets 104 that pass through the webs 100 of members 90.

The bucket rack 8 and top rear section 4 are hinged to the front step section in the new ladders by the some bracket means 12. This comprises a pair of parallel, spaced apart flanges 106 and 108 that extend normally from one side of the transverse web 110 and a third flange 112 that extends from the opposite side of web 110 substantially parallel to the flanges 106 and 108. The third flange 112 has an integral U-shaped offset 114 positioned between the web 110 and the free end 116 of the flange 112. The flange 112 is joined to the web 110 by the L-shaped rib 118 that provides a small longitudinal slot 120 along the surface of web 110 that faces the flange 112.

The bracket means 12 is fixed to the front section side rails 18 by rivets 122 that pass through the holes 124 in flange 108 and through the face portion 126 of side rails 18. The free end 128 of side flange 30 of side rail 18 fits into the slot 120 thereby locking the bracket means 12 to the side rail 18.

Figure 5:
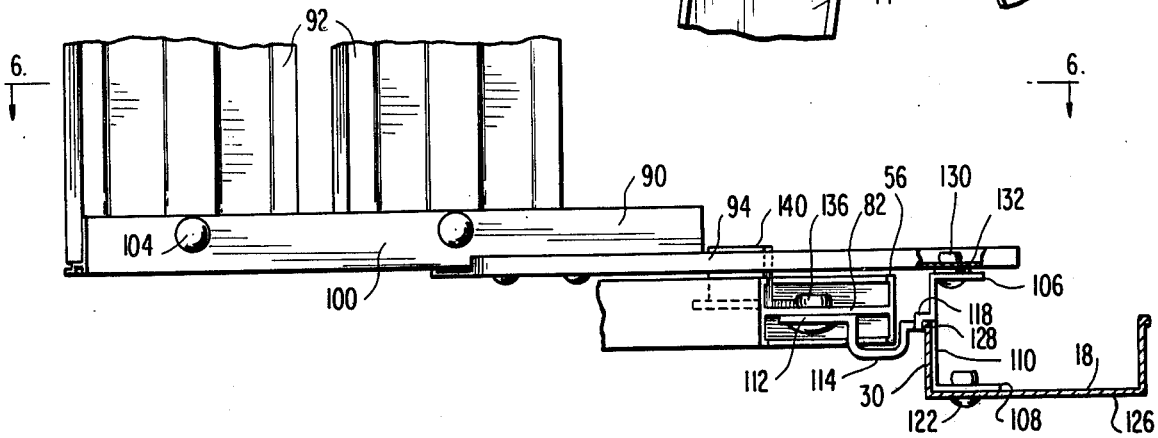
FIG. 5 is a sectional view taken on the line 5—5 of FIG. 4.

The bucket rack is pivoted at each side upon bracket means 12 by a rivet 130 passing through flange 106 and channel 94 with a washer 132 therebetween. Also, the upper ends 134 of upper side channel members 44 are pivoted on bracket means 12 by rivets 136 that pass through holes 138 in flanges 112 and through the web portions 82 of the channels 44. As can be seen in FIG. 5, the offsets 114 provide clearance in pivotal movement of top rear section 4 for the inside lateral flanges 56 of channels 44.

Figure 4:
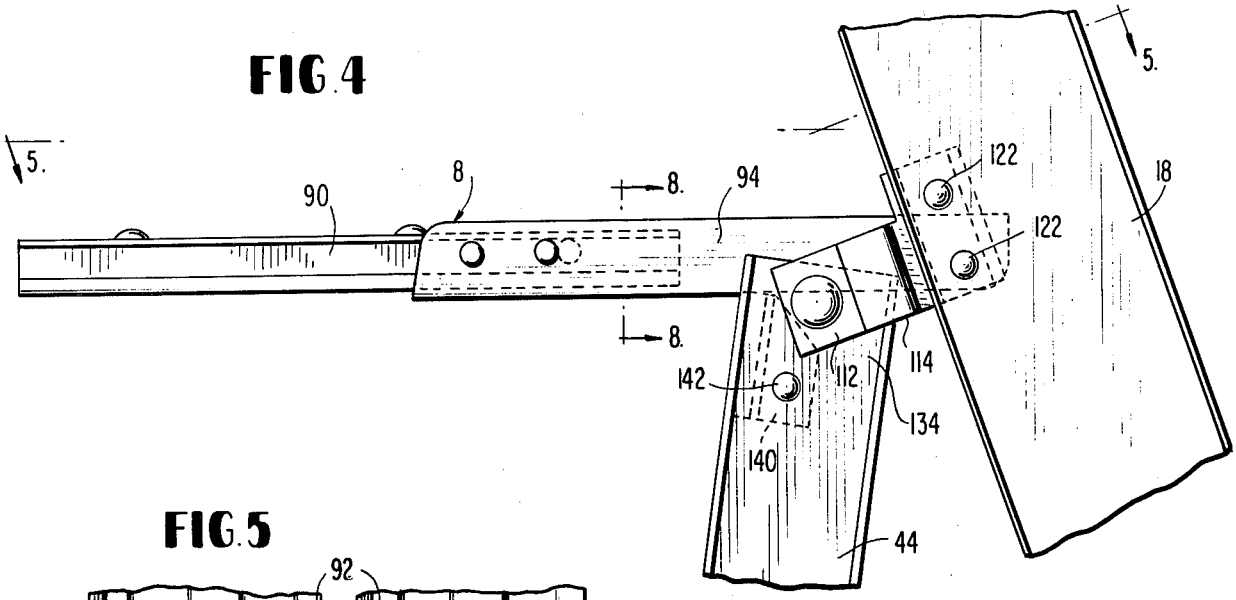
FIG. 4 is a fragmentary, lateral view of the bucket rack and top rear bracket means of the new ladder.
Figure 6:
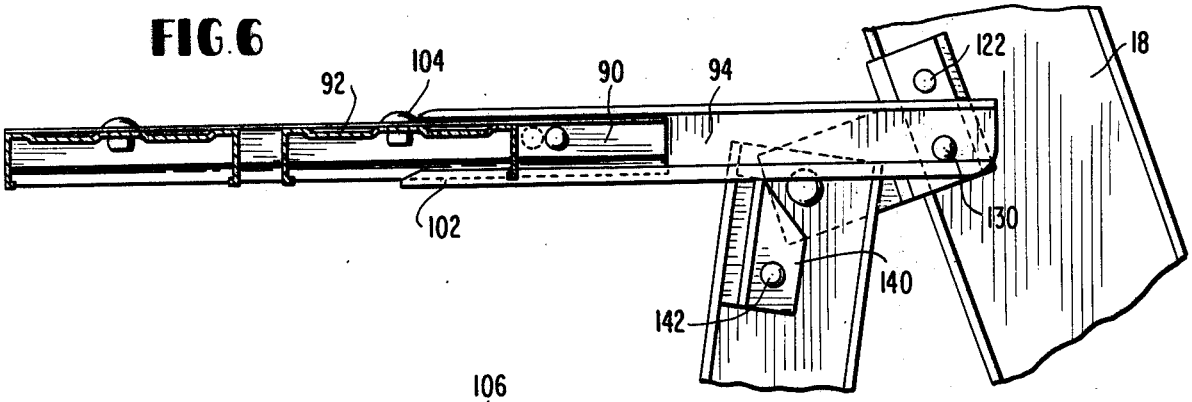
FIG. 6 is a fragmentary, sectional view taken on the line 6—6 of FIG. 5.
Figure 7:
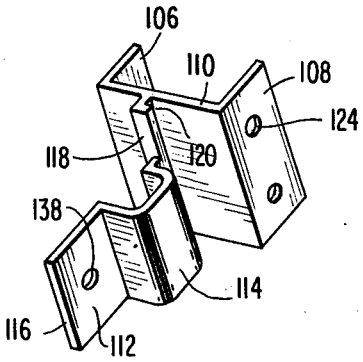
FIG. 7 is an isometric view showing details of the bucket and top rear section bracket.
Figure 8:
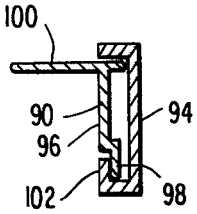
FIG. 8 is a sectional view taken on the line 8—8 of FIG. 4.

The bucket rack 8 can move from an in-line or closed position (see FIGS. 9 and 10) to a bucket support, extended position (see FIGS. 4–6). The front side flange 36 of top step 20 checks movement of the bucket rack 8 in the closed position. Movement to the support position is limited by stop members 140 that are fixed to top side channels 44 by rivets 142.

Figure 3:
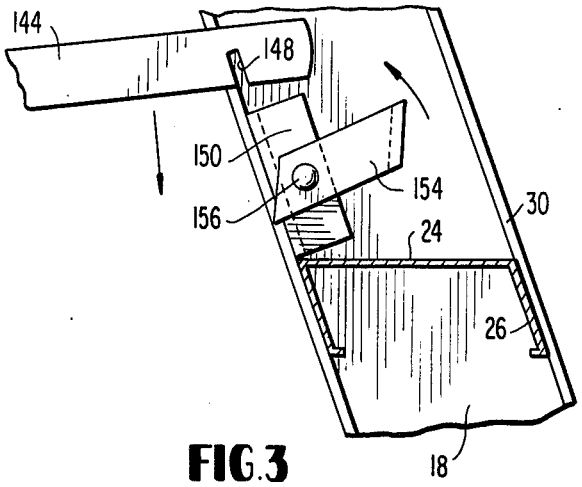
FIG. 3 is a fragmentary, lateral view partially in section of the spreader lock portion of the new ladder.
Figure 2:
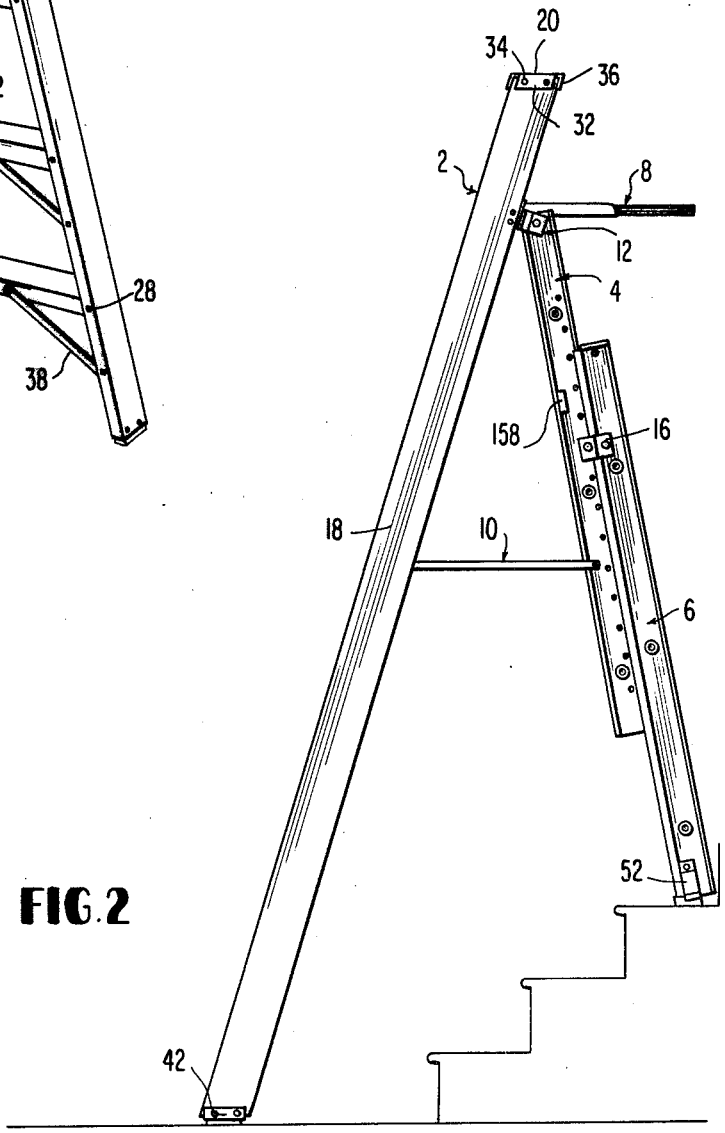
FIG. 2 is a lateral view of the ladder of FIG. 1 arranged in its stair well configuration.

The spreader strap means 10 comprises the straps 144 pivoted at one end 146 upon top rear side channels 44 and have angled slots 148 in the opposite end. The spreader strap brackets 150 are fastened to flanges 30 by rivets 152 and L-shaped lock toggles 154 are pivoted on the brackets 150 by rivets 156. When straps 144 are moved in the direction of the left arrow in FIG. 3, slots 148 engage brackets 150 and toggles 154 are moved in the direction of the right arrow of FIG. 3 to lock the straps 144 to maintain the ladder either in the step (FIG. 1) or stair well configuration (FIG. 2). In the extension ladder configurations (FIGS. 15 & 16), the straps 144 are held aligned to the top rear channels 44 by retainers 158.

The spring biased hooks 14 are pivoted upon top rear channels 44 by large rivets 160. Spacer rings 162 hold the hooks 14 away from the channels 44 so they clear the transverse flanges 56. Coil springs 164 held at one end by pins 166 are linked at the other end to hooks 14 through holes 168.

Figure 9:
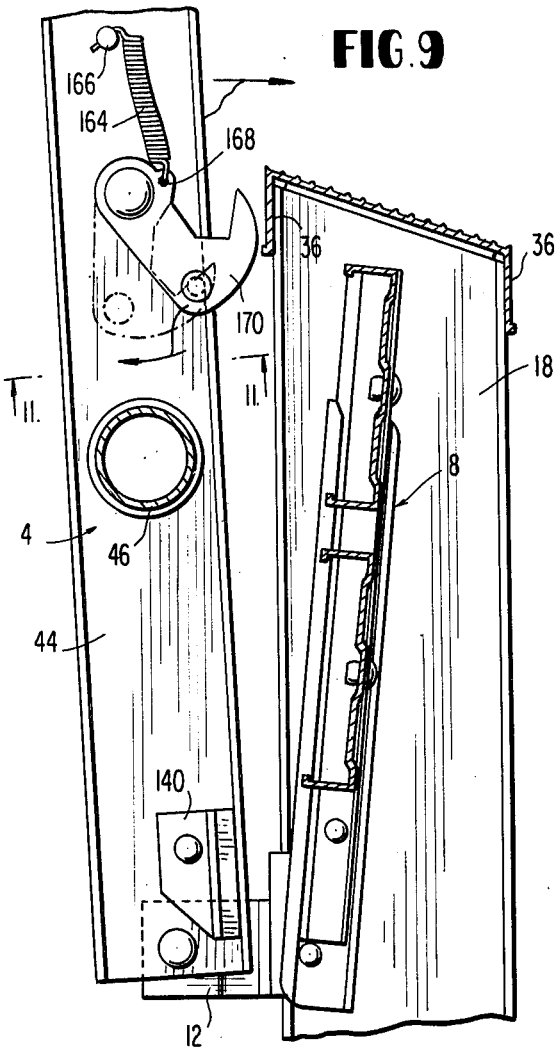
FIG. 9 is a fragmentary, lateral, sectional view showing a portion of the ladder in its extension ladder configuration.
Figure 10:
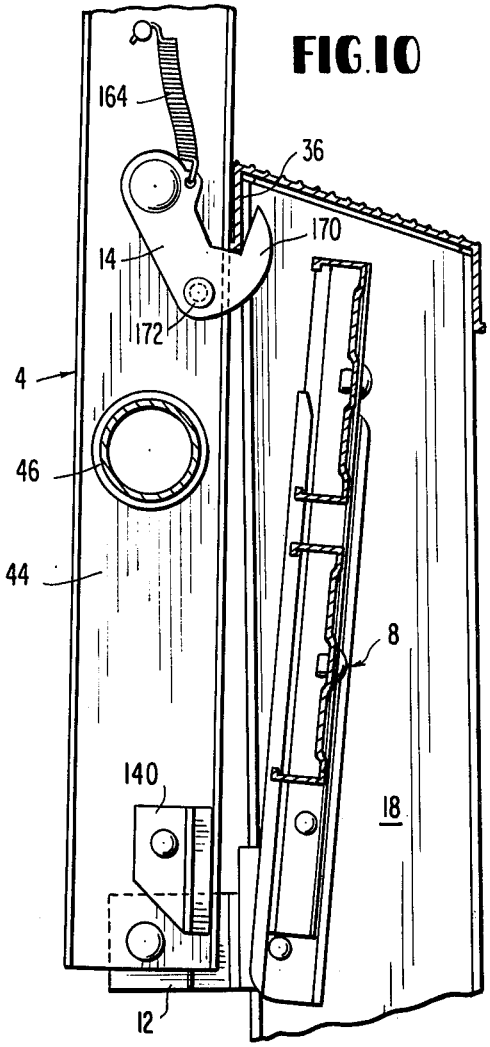
FIG. 10 is a sectional view corresponding to FIG. 9 showing the rear section of the ladder locked to the front section when in its extension ladder configuration.
Figure 11:
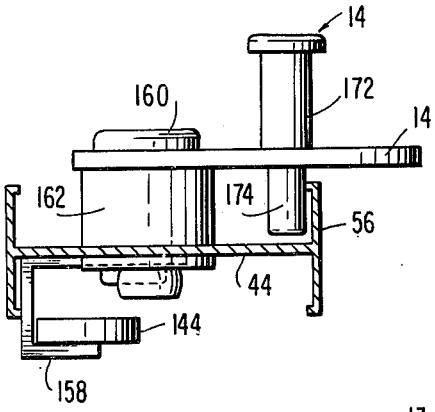
FIG. 11 is a sectional view taken on the line 11—11 of FIG. 9.
Figure 12:
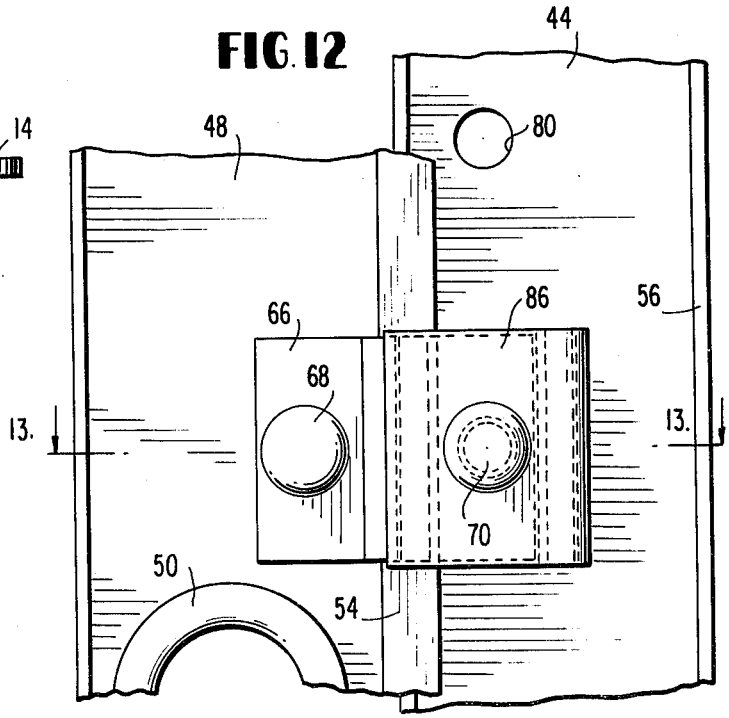
FIG. 12 is a lateral, fragmentary view of the snap-lock portion of the new ladder.

As can be seen in FIG. 9, when the top rear section 4 is raised to place the ladder in extension configuration, movement of section 4 as indicated by the top arrow in FIG. 9, brings the free ends 170 of hooks 14 against top step side flange 36. The hooks 14 automatically move as indicated by the bottom arrow of FIG. 9 against the spring bias to snap over flange 36 as shown in FIG. 10. The springs 164 retain the hooks 14 in such position until the user wishes to convert the ladder to another configuration. This can be done by grasping the through pins 172 to pull the hooks against the spring bias away from the flange 36 at which point the rear sections 4 and 6 may be returned to a lowered position. The hooks automatically reset for locking engagement upon the next occasion the ladder will be converted into its extension form. The extensions 174 of pins 172 cooperate with flanges 56 of channels 44 to check the swing of hooks 14 so they are ready for automatic hooking on to the top step flange 36.

The new ladders are advantageously stored with the rear sections 4 and 6 lowered in line with the front section 2 (see FIG. 16) and with bottom rear section 6 positioned on top rear section 4 so that the ladder may be quickly put into the stepladder form by use of the spreader strap means 10 as previously explained. Experience has shown that most frequent use of the ladders is in the stepladder form.

If work with the ladder is to be performed on stairs, the stair well configuration is quickly created by operation of the snap pin units 16 as previously explained to properly adjust the combined length of rear sections 4 and 6 to provide the necessary arrangement to permit the ladder to assume an upright position on the stairs as seen in FIG. 2.

For work requiring access to a wall or other support surface above a height that can be reached with the step form (FIG. 1) or the single length form (FIG. 16), the new ladders quickly convert to an extension form as seen in FIG. 15. To accommodate special situations where space conditions between the ground or horizontal support surface 176 and vertical support surface 178 will not accommodate the full extension length of the ladder, its length can be shortened by relative movement of sections 4 and 6 in the same manner as used in arranging the ladder in its stair well configuration.

Other embodiments of the new ladders than specifically illustrated have been fabricated. For example, other forms of feet members 42 and 52 may be used including those which use rollers designed to engage support surfaces, e.g., vertical wall 178. Such a modified foot member is shown in FIG. 17 wherein the bottom rear section 6 has attached to its end 180 the rubber foot pad 182 fixed to the trapezoidal support 184. In addition, the rubber wheel 188 having a serrated periphery 190 is rotably held on end 180 by the bracket 192 and pin 194. In use of the ladder in its step or stair well configuration, the rubber pad 182 will rest on the support surface 176, but when the ladder is in the extension configuration, the vertical support surface 178 will be engaged by the wheel 188, not by the pad 182. Since the wheel 188 can rotate, a movement of the ladder along the support surface 178 will not mar or otherwise damage the surface 178.

The embodiments of the invention in which an exclusive property or privilege is claimed are defined as follows:

1. In a combination step, stair well and extension ladder having a front step section comprising a pair of side rails with a plurality of spaced apart steps carried therebetween, a top rear section formed by two upper side channel members with rungs fixed therebetween at spaced intervals, a bottom rear section formed by two lower side channel members, that telescope with said upper side channel members, with rungs fixed therebetween at spaced intervals, a bucket rack hinged upon the ladder and spreader strap means to hold the ladder sections in the stepladder or stair well configuration, the improvement that comprises in combination:

bracket means by which said top rear section and said bucket rack are both hinged to said front step section, said bracket means comprising a pair of parallel, spaced apart flanges extending perpendicularly from one side of a transverse web and a third flange extending from the opposite side of said web parallel to said pair of flanges, said third flange having an integral U-shaped offset positioned between said web and the free end of said third flange, said bracket means being fixed by one of said flanges of said pair to a side rail of said front step section, said bucket rack being pivoted upon the second flange of said pair, and an upper side channel member of said top rear section being pivoted at the top thereof to said third flange.

2. The combination ladder of claim 1 wherein said upper side channel members have an I cross-section and are pivoted to said third flanges by rivets that pass through the middle of said I cross-section.

3. The combination ladder of claim 2 wherein a hook is pivoted at one end thereof to each of said upper side channel members at a distance therealong from said third flanges whereby said hooks engage the top step of said front step section when the ladder is in the extension ladder configuration.

4. The combination ladder of claim 3 wherein said hooks are spring biased to swing away from said third flanges and said hooks carry transverse pins that limit said hook swing and provide handles by which a user of the ladder may disengage the hooks from said top step to undo said extension ladder configuration.

5. The combination ladder of claim 4 wherein said top step comprises a flat step portion, a pair of depending end flanges by which the step is fastened to said side rails and a pair of depending side flanges, said hooks engaging one of said side flanges when the ladder is in said extension ladder configuration.

6. The combination ladder of claim 1 wherein said bucket rack comprises a pair of first parallel channel members, a plurality of spaced apart slats fixed at their ends between said first channel members, a pair of second parallel channel members that telescope with said first channel members, said second channel members being pivoted at an end thereof to said bracket means by rivets that pass through an end thereof and said second flange of said pair of flanges.

7. The combination ladder of claim 1 wherein said lower side channel members have an I cross-section with one of the cross elements of the I having integral L-spaded lugs extending normally therefrom at either side forming a rabbet longitudinally along a side thereof, and said top rear section telescopes with said bottom rear section by the cross-elements of the I cross-section of the upper side channel members being slideably captured by in said rabbets of said lower side channel members.

8. The combination ladder of claim 1 wherein snap pin means for holding said upper and lower rear sections in varied relative telescoped positions comprises a channel having a pair of transverse parallel sides extending from one face thereof, an integral flange projecting from the opposite face of said channel, said channel being fastened by said integral flange to said lower rear section, a spring-biased pin slideably carried in holes extending through said pair of parallel sides, a longitudinal row of spaced apart holes in the center portion of said top channel members of said upper rear section into which said spring-biased pin may extend and pull means provided on the outboard end of said pin to permit the pin to be retracted from any of the holes in said longitudinal row.

* * * * *